US011732500B2

(12) United States Patent
Mohammed et al.

(10) Patent No.: US 11,732,500 B2
(45) **Date of Patent: *Aug. 22, 2023**

(54) LEVER RETURN MECHANISM USING MAGNETS

(71) Applicant: Schlage Lock Company LLC, Carmel, IN (US)

(72) Inventors: Saagar Mohammed, Alappuzha (IN); Allen Mani, Thrissur (IN); Aditya Hebilkar, Ballari (IN); Abdul Khadar Jailani Mannanayak, Bangalore (IN); Vijayakumar Mani, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 216 days.

This patent is subject to a terminal disclaimer.

(21) Appl. No.: 17/081,567

(22) Filed: Oct. 27, 2020

(65) Prior Publication Data

US 2021/0054650 A1 Feb. 25, 2021

Related U.S. Application Data

(60) Continuation of application No. 16/207,532, filed on Dec. 3, 2018, now Pat. No. 10,815,690, which is a (Continued)

(51) Int. Cl.
*E05B 47/00* (2006.01)
*E05B 3/06* (2006.01)
(Continued)

(52) U.S. Cl.
CPC ..... *E05B 3/06* (2013.01); *E05B 1/003* (2013.01); *E05B 15/0073* (2013.01);
(Continued)

(58) Field of Classification Search
None
See application file for complete search history.

(56) References Cited

U.S. PATENT DOCUMENTS 2,238,513 A 4/1941 Ward
2,446,336 A 8/1948 Mark et al.
(Continued)

FOREIGN PATENT DOCUMENTS

EP 0585559 A1 3/1994
EP 1859457 A1 11/2007
(Continued)

OTHER PUBLICATIONS

International Search Report; International Searching Authority; International Patent Application No. PCT/US2018/036264; dated Dec. 21, 2018; 4 pages.
(Continued)

*Primary Examiner* — Carlos Lugo
(74) *Attorney, Agent, or Firm* — Taft Stettinius & Hollister LLP

(57) ABSTRACT

A lever apparatus having a lever connected to a latch assembly operable to open the latch when rotated to a second position from a first position under an actuation torque. The apparatus further includes a magnet assembly with first and second magnets operably coupled to the lever apparatus. The magnet assembly is operable to generate a return torque in an opposite direction to that of the actuation torque such that the lever is returned to the first position after the actuation torque is removed from the lever.

18 Claims, 4 Drawing Sheets

Related U.S. Application Data division of application No. 15/615,333, filed on Jun. 6, 2017, now Pat. No. 10,145,143.

(51) Int. Cl.

| | |
|---|---|
| ***E05B 1/00*** | (2006.01) |
| ***E05C 19/16*** | (2006.01) |
| ***E05C 17/56*** | (2006.01) |
| ***E05B 15/00*** | (2006.01) |
| *E05B 83/06* | (2014.01) |

(52) U.S. Cl.

CPC ..... *E05B 47/0038* (2013.01); *E05C 17/56* (2013.01); *E05C 19/16* (2013.01); *Y10T 292/11* (2015.04); *Y10T 292/82* (2015.04)

(56) References Cited

U.S. PATENT DOCUMENTS

| | | | |
|---|---|---|---|
| 2,471,634 | A | 5/1949 | Mark et al. |
| 2,514,927 | A | 7/1950 | Bernhard |
| 2,565,891 | A | 8/1951 | Sherman |
| 2,797,655 | A | 7/1957 | Morehouse |
| 2,947,507 | A | 8/1960 | Schlage et al. |
| 2,975,531 | A | 3/1961 | Malenich |
| 3,288,511 | A | 11/1966 | Favano |
| 3,326,588 | A | 6/1967 | Clark |
| 3,468,576 | A | 9/1969 | Beyer et al. |
| 3,596,958 | A | 8/1971 | Bowerman |
| 3,691,688 | A | 9/1972 | Kaiserswerth |
| 3,790,197 | A | 2/1974 | Parker |
| 4,099,755 | A | 7/1978 | Anderson |
| 4,832,385 | A | 5/1989 | Llort |
| 5,443,570 | A | 8/1995 | Hirano |
| 5,887,465 | A | 3/1999 | Shen |
| 6,174,005 | B1 | 1/2001 | Norton |
| 6,289,557 | B1 | 9/2001 | Manson et al. |
| 6,386,602 | B1 | 5/2002 | Lan |
| 6,588,811 | B1 | 7/2003 | Ferguson |
| 6,594,861 | B2 | 7/2003 | Dimig et al. |
| 6,880,872 | B2 | 4/2005 | Eller et al. |
| 6,929,291 | B2 | 8/2005 | Chen |
| 6,971,147 | B2 | 12/2005 | Halstead |
| 7,012,495 | B2 | 3/2006 | Underwood et al. |
| 7,137,657 | B2 | 11/2006 | Wu et al. |
| 7,267,378 | B2 | 9/2007 | Drumm |
| 7,583,500 | B2 | 9/2009 | Ligtenberg et al. |
| 7,775,567 | B2 | 8/2010 | Ligtenberg et al. |
| 7,942,458 | B2 | 5/2011 | Patterson |
| 8,016,330 | B2 | 9/2011 | Fullerton et al. |
| 8,522,482 | B2 | 9/2013 | Buck |
| 8,789,864 | B2 | 7/2014 | Chen |
| 8,967,686 | B2 | 3/2015 | Rudhager et al. |
| 9,151,764 | B2 | 10/2015 | Crane et al. |
| 10,145,143 | B1 | 12/2018 | Mohammed et al. |
| 2003/0033690 | A1 | 2/2003 | Lin |
| 2006/0200996 | A1 | 9/2006 | Pearman |
| 2007/0007775 | A1 | 1/2007 | Gallas et al. |
| 2008/0307836 | A1 | 12/2008 | Kim et al. |
| 2009/0021333 | A1 | 1/2009 | Fiedler |
| 2012/0006146 | A1 | 1/2012 | Warren |
| 2013/0300136 | A1 | 11/2013 | Suresha et al. |
| 2014/0000170 | A1 | 1/2014 | Buck |
| 2015/0368937 | A1 | 12/2015 | Da Deppo et al. |

FOREIGN PATENT DOCUMENTS

| | | | |
|---|---|---|---|
| EP | 2568101 | A2 | 3/2013 |
| FR | 1179194 | A | 5/1959 |
| GB | 2510470 | A | 8/2014 |
| JP | 05340149 | A | 2/1996 |

OTHER PUBLICATIONS

Written Opinion; International Searching Authority; International Patent Application No. PCT/US2018/036264; dated Dec. 21, 2018; 8 pages.

European Examination Report, European Patent Office, European Patent Application No. 18813402.7, 4 pages.

Extended European Search Report, European Patent Office, European Patent Application No. 18813402.7, 6 pages.

LEVER RETURN MECHANISM USING MAGNETS

CROSS-REFERENCE TO RELATED APPLICATIONS

The present application is a continuation of U.S. patent application Ser. No. 16/207,532 filed Dec. 3, 2018 and issued as U.S. Pat. No. 10,815,690, which is a divisional of U.S. patent application Ser. No. 15/615,333 filed Jun. 6, 2017 and issued as U.S. Pat. No. 10,145,143, the contents of each application incorporated herein by reference in their entirety.

TECHNICAL FIELD

The present disclosure generally relates to a lever return apparatus having a magnetic mechanism operable for returning a lever to an initial or base position after actuation.

BACKGROUND

Lever handles typically have a mechanism to return the lever handle to an original or base position after movement to a second or actuation position to cause unlatching of a latch mechanism. Some return mechanisms include springs and other mechanical elements that create unwanted noise that occurs during a "bounce back" to a home position after actuation. Furthermore the mechanical springs can fail over time as the spring material yields under cycle fatigue which causes the handle to droop. In some cases, mechanical elements may completely break causing the handle assembly to become inoperable. Accordingly there remains a need for further contributions in this area of technology.

SUMMARY

One embodiment of the present disclosure includes a lever apparatus with a magnetic mechanism operable for returning the lever handle to an initial or base position after movement to a second position. Other embodiments include apparatuses, systems, devices, hardware, methods, and combinations for magnetic actuation of a lever handle. Further embodiments, forms, features, aspects, benefits, and advantages of the present application shall become apparent from the description and figures provided herewith.

BRIEF DESCRIPTION OF THE FIGURES

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
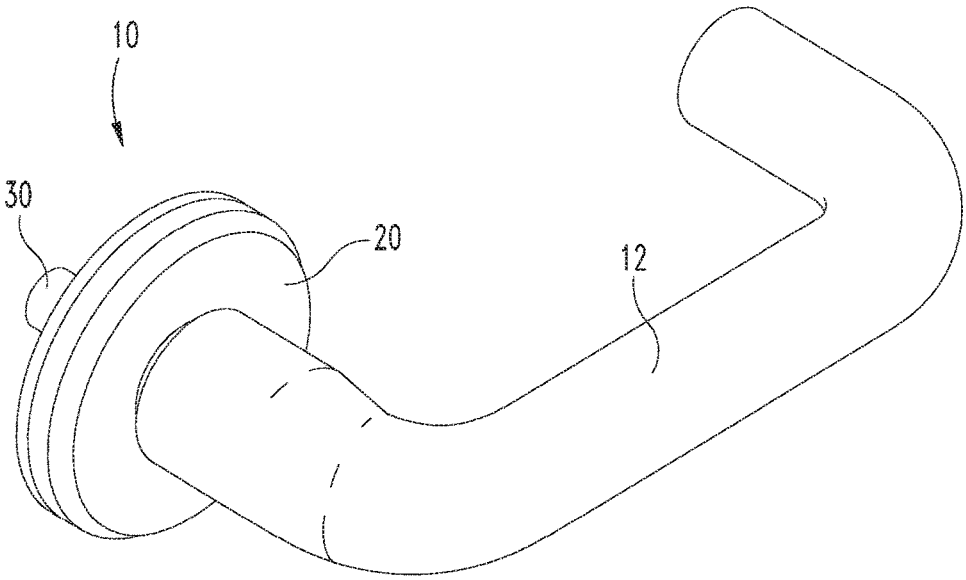
FIG. 1 is a perspective view of a lever handle apparatus according to one embodiment of the present disclosure.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
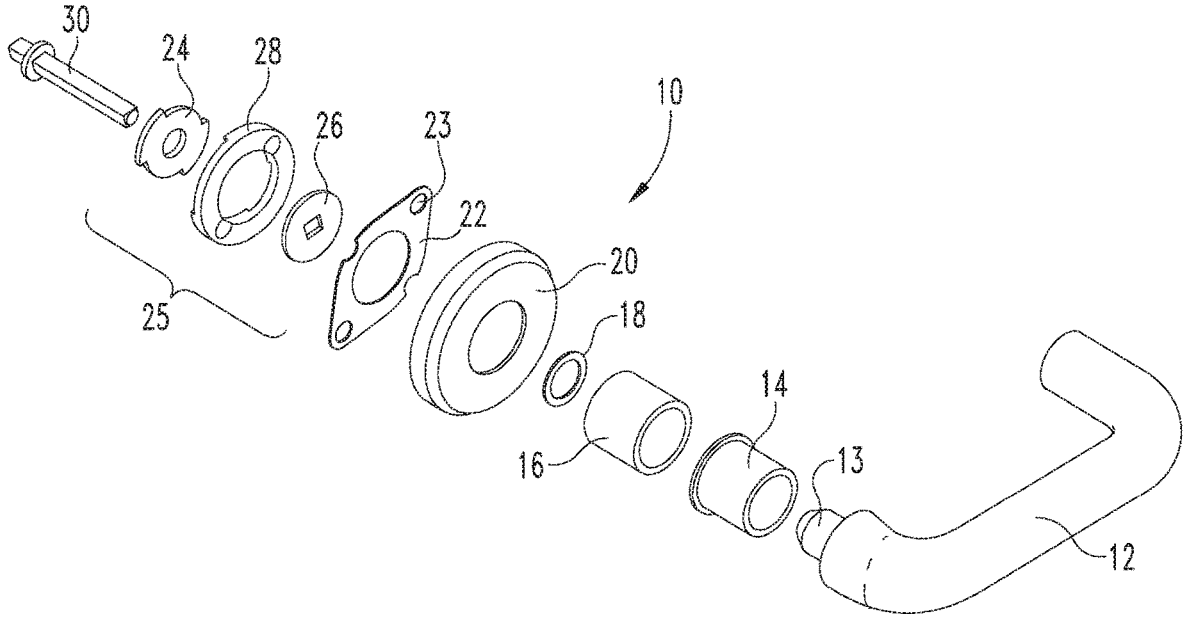
FIG. 2 is an exploded view of the lever handle apparatus of FIG. 1.
Figure 3:
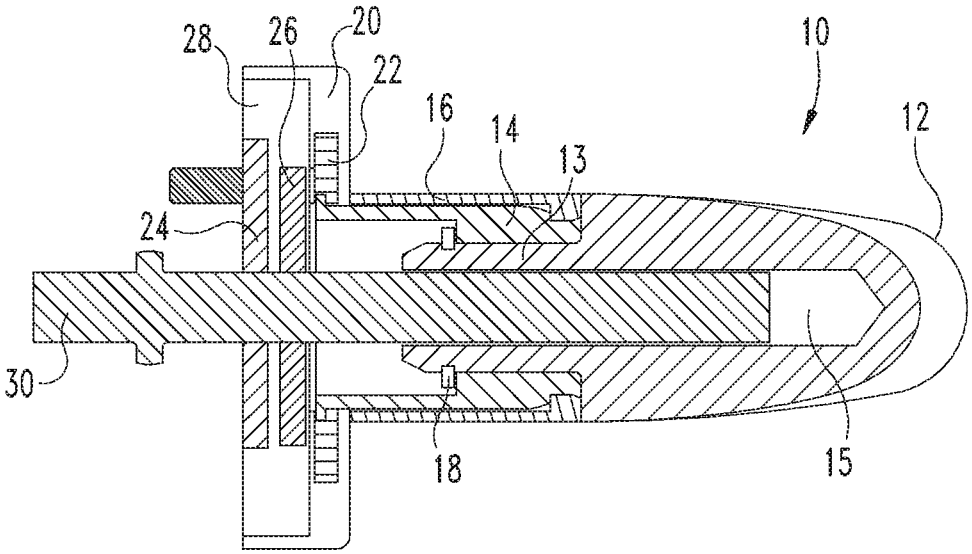
FIG. 3 is a cross-sectional view of the lever handle apparatus of FIG. 1.

Referring now to FIGS. 1-3, a lever apparatus 10 is disclosed in a perspective view, an exploded view and a cross-sectional view, respectively. A lever handle 12 is configured to be grasped and rotated in a clockwise and/or counter-clockwise orientation to unlatch a structure (not shown) such as a door or a window and the like. The lever handle 12 can be operably connected to a latch mechanism (not shown) as is known to one skilled in the art. When the lever handle 12 is rotated from an initial base or first position to a second position, the latch mechanism is moved from a latched orientation to an unlatched or open orientation to permit opening of the structure. It should be noted that the illustrative lever handle 12 is exemplary in nature and that other forms of actuation levers are contemplated herein. For example, rotatable knobs and thumb lever actuators or the like may be utilized and remain within the teachings of this disclosure.

The lever apparatus 10 may include components configured to reduce wear or fretting and the like due to friction between movable members in in the lever apparatus 10. For example, a bushing sleeve 14 may be disposed over an end portion of a connection joint 13 extending from one end of the lever handle 12. A bushing 16 may be operably engaged with the bushing sleeve 14 so as to reduce friction during operation. A retaining washer 18 can be positioned adjacent an end of the connection joint 13 in some embodiments of the present disclosure to releasably lock the bushing sleeve 14 and bushing 16 to the lever 12. A rose 20 can be positioned over a mounting plate 22 after the mounting plate is fastened or otherwise attached to a structure (not shown). In some aspects the mounting plate 22 may have one or more apertures 23 formed through the walls thereof.

A magnet assembly 25 can be operably coupled to the lever apparatus 10 to facilitate a return torque on the lever handle 12 after the lever handle has been moved from the first position. The magnet assembly 25 includes a first magnet 24, a second magnet 26 and a magnet cage or holder 28 disposed therebetween. In one form, the second magnet 26 is rotatable and the first magnet 24 is fixed relative to the lever handle assembly 10. In other forms the magnet assembly 25 may be configured such that the first magnet 24 is rotatable and the second magnet 26 is fixed. In either case, the rotatable magnet is operably coupled to the lever handle 12.

A spindle 30 extends through the magnet assembly 25, the mounting plate 22 and rose 20 to connect with the connection joint 13 of the lever handle 12. The spindle 30 may extend into a receiving channel 15 (see FIG. 3) formed internal to the lever 12. In some forms, the cross-sectional shape of the channel 15 can be substantially similar to the cross-sectional shape of the spindle 30, so as to provide means for transmitting torque between the lever handle 12 and the spindle 30. The spindle 30 is operable for coupling the lever handle 12 to a latch mechanism (not shown). When the lever handle 12 is rotated from the first position to the second position, the spindle 30 will open the latch mechanism as is conventional.

Figure 4:
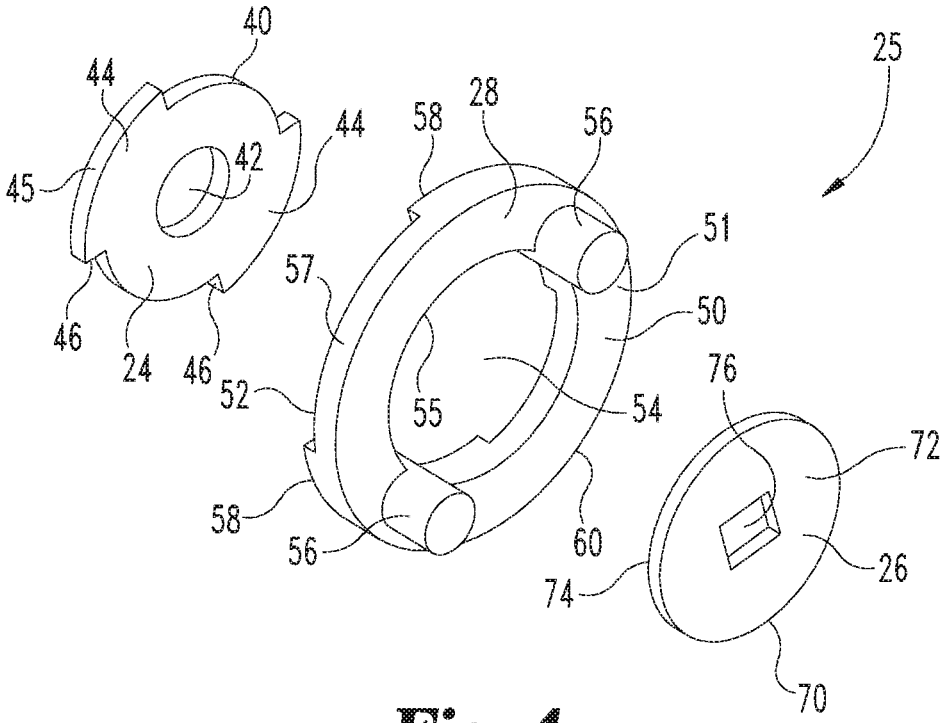
FIG. 4 is an enlarged view of a portion of a magnet assembly illustrated in FIG. 2.

Referring now to FIG. 4, the magnet assembly 25 shown in FIG. 1 is illustrated in an enlarged view. The first magnet 24 can include an outer perimeter 40 formed in an arcuate ring structure. The outer perimeter 40 may include other forms or shapes in alternative embodiments. The first magnet 24 may include a through aperture 42 formed through a region radially inward of the outer perimeter 40. The through aperture 42 can be sized so as to permit certain components, such as the spindle 30 to pass therethrough. In the exemplary embodiment, the first magnet 24 remains in a fixed position, therefore the spindle 30 can pass through the through aperture 42 without engagement with the first magnet 24. The first magnet 24 can include one or more ears 44 that extend radially outward from the outer perimeter 40 at a height defined by an extension wall 46. The one or more ears 44 may include an outer perimeter 45 with an arcuate shape similar to the shape of the outer perimeter 40. In other forms, the shapes of the outer perimeters 40, 45 may different from one another and may include portions with different shapes. The ear extensions 44 can be used to prevent the first magnet 24 from rotating when the lever handle 12 is actuated as will be described in more detail below.

A magnet holder 28 can be formed in a substantially ring shaped structure 51 defined by a first side 50 and an opposing second side 52. The ring structure 51 includes an aperture 54 formed therethrough and is further defined between inner and outer perimeter walls 55, 57 respectively. The magnet holder 28 can include at least one post 56 and as illustrated in the disclosed embodiment includes two posts 56 extending axially outward from the first side 50 of the magnet holder 28. In some forms the at least one post can be a separate component and in other forms the at least one post can be integrally formed with the magnet holder 28. The one or more posts 56 are configured to engage with corresponding apertures 23 in the mounting plate 22 (see FIG. 2) to prevent rotational movement of the magnet holder 28 relative to the mounting plate 22. The mounting plate 22 can be fixedly attached to a movable structure such that the magnet holder 28 and the first magnet 24 remain in fixed position with respect to the structure. In one form the posts 56 may be shaped to correspond with a shape of the apertures 23. In other forms the posts 56 and the apertures 23 may be formed with dissimilar shapes. By way of example and not limitation, the cross sectional shapes can include circular, square, arcuate segments, linear segments as well as other configurations as desired.

At least one projection 58 extends axially outward from the second side 52 of the magnet holder 28 proximate the outer perimeter wall 57. The projections 58 are positioned between portions 60 of the outer perimeter wall 57 devoid of the outwardly extending projections 58. The projections 58 of the magnet holder 28 act as a containment feature or abutment for the first magnet 24. The projections 58 operate to engage with the ears 44 proximate the extension walls 46 of the first magnet 24 to prevent relative rotation.

The second magnet 26 can include an arcuate outer perimeter wall 70 extending between first and second side walls 72, 74 respectively. A through aperture 76 can be formed through the first and second side walls 72, 74 radially inward from the outer perimeter wall 70. The through aperture 76 can include a cross-sectional shape to receive and engage with the spindle 30 after assembly of the lever apparatus 10. In the illustrative embodiment, the aperture 76 includes a square cross-section configured to engage a portion of the spindle 30 also having a square cross-section such that second magnet 26 can be rotatingly driven by the spindle 30 or vise-versa. In other embodiments the through aperture 76 may not directly engage with the spindle 30 through a closely fitting similarly shaped feature, but may include mechanical fastening means such as clips, threaded fasteners, weld or other means as would be known to a skilled artisan.

The magnet holder 28 (FIG. 3) is configured to separate the first and second magnets 24, 26 and permit relative rotation, but to maintain a close proximity so that the magnetic forces of the magnets 24, 26 can be effective in interacting with one another. In some forms the magnet holder 28 may be formed from a magnetic material. In other forms the magnet holder 28 may be formed from a non-magnetic material such as a plastic or a nonferrous composite material. In this manner, the magnets 24, 26 may be rotated relative to one another and out of magnetic alignment when the lever handle 12 is actuated and still have sufficient magnetic flux to return the magnets into neutral alignment after the actuation force is removed from the lever handle 12.

Figure 5:
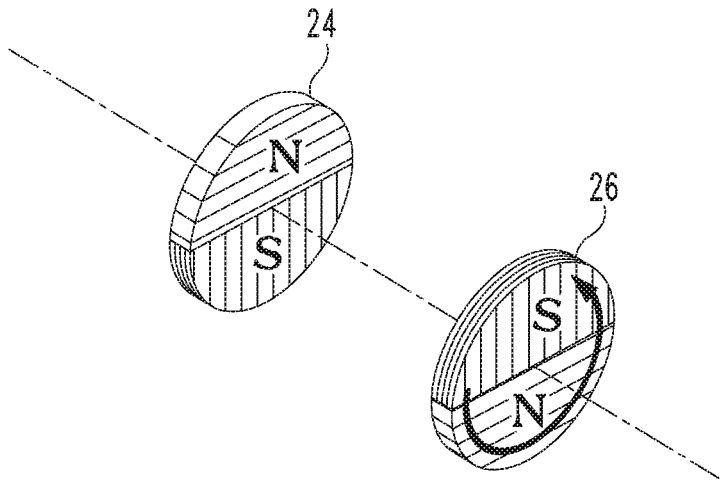
FIG. 5 schematic view of a portion of the magnet assembly with first and second magnets shown in schematic form.

Referring now to FIG. 5, the first magnet 24 and the second magnet 26 are shown in schematic form to illustrate that each magnet 24, 26 is defined by a north pole in a first half and a south pole in a second half thereof. When the first and second magnets 24, 26 are aligned such that the north pole of the first magnet 24 is aligned with the south pole of the second magnet 26 then the magnets 24, 26 are in a neutral position. An external actuation force on the lever handle 12 will cause rotation of the lever apparatus 10 and the magnets 24, 26 will move out of neutral alignment with one another. The rotation of the second magnet 26 will cause the respective south polls and north polls to become aligned and thus produce a repelling magnetic force. When the external actuation force is removed from the lever apparatus 10, the magnetic forces of the first and second magnets 24, 26 act to rotate the second magnet back into neutral alignment which in turn will cause the lever handle to move back to the original or latched position.

It should be noted that while the exemplary embodiment illustrates two magnets with a north pole in one half and a south pole in the other half, other magnet configurations may be utilized and remain within the teachings of this disclosure. The term "magnet" can include, but is not limited to, a plurality of separate magnets with alternating poles as well as single magnets with multiple north and south poles formed in predefined locations therein. Furthermore the configuration of the magnets and magnet assemblies can be designed to tailor the magnet generated torque as a function of a lever handle angle. For example, the return torque may be designed to increase linearly over a first range of handle angles and then level out or decrease over a second range of lever angles. In one exemplary embodiment, the return torque may be set at 0 lbf-in when the lever handle is in a first or home position and may increase to 6 lbf-in over a first range of angles such as, for example, twenty degrees of rotation and then remain at 6 lbf-in over the remaining range of rotation angles. It should be understood that other forms and variations in torque profile or pattern as a function of lever handle angle are contemplated by the present disclosure. In one form, the torque profile can be designed so as to minimize rotational speed and lever bounce upon return to the original home position after actuation.

The first and second magnets 24, 26 can be formed from any permanent magnet material as would be known to one skilled in the art. The size and shape of the magnets, including widths, heights, thicknesses etc., can vary depending on the particular application and design constraints as would be known to the skilled artisan. The magnets may be formed from magnetic metallic elements such as paramagnetic elements, ferromagnetic elements including material based from iron ore, cobalt and nickel, as well as rare-earth metals such as gadolinium and dysprosium, composites, ceramic, or ferrite. In some forms, the magnets can be made of a sintered composite of powdered iron oxide and barium/strontium carbonate ceramic. In other forms, the magnets can be alnico magnets made by casting or sintering a combination of aluminum, nickel and cobalt with iron and trace elements added to enhance the properties of the magnet. In yet other forms, the magnets may be rare-earth magnets such as (lanthanoid) elements, samarium-cobalt and neodymium-iron-boron (NIB) magnets, single-molecule magnets (SMMs) and single-chain magnets (SCMs), nanostructured magnets. In other forms, the magnets may be rare-earth-free permanent magnets.

Figure 6:
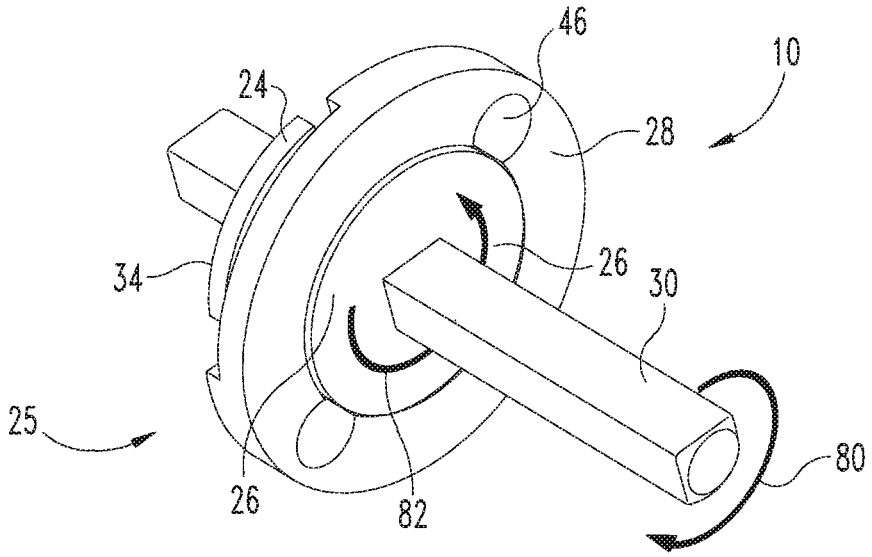
FIG. 6 is a perspective view of a portion of the lever handle apparatus with arrows representing the direction of the torque from an actuation force and the return torque caused by the magnet assembly.
Figure 7:
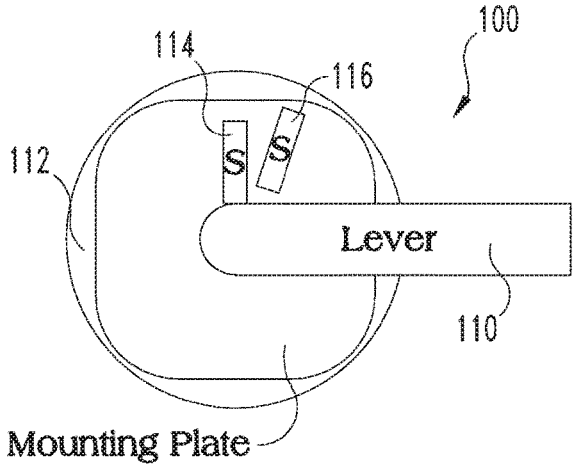
FIGS. 7-8 are schematic views of a lever handle apparatus according to another embodiment of the present disclosure.
Figure 8:
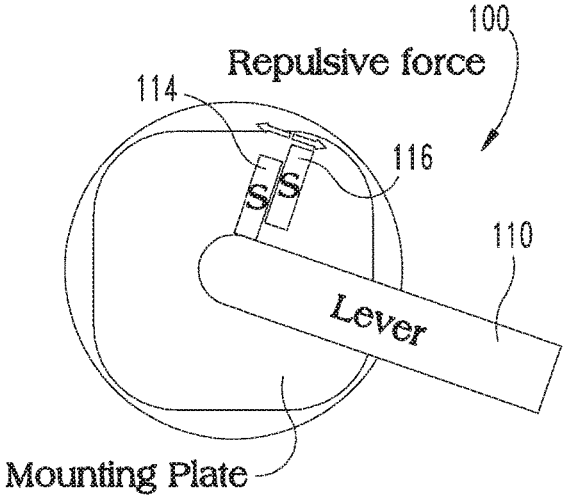
Figure 9:
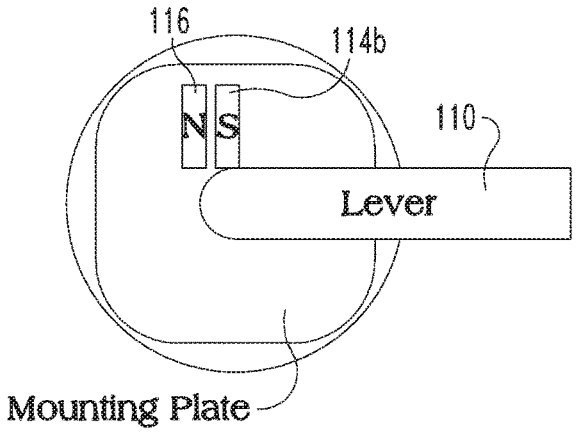
FIGS. 9-10 are schematic views of a lever handle apparatus according to another embodiment of the present disclosure.
Figure 10:
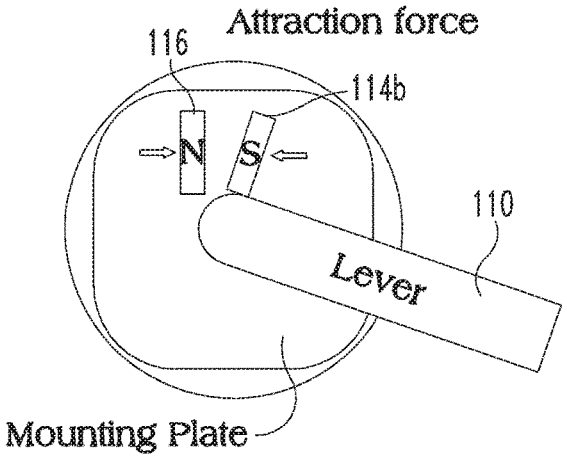

Referring now to FIG. 6, a perspective of a portion of the lever apparatus 10 is shown with acting torque inputs illustrated by their respective arrows 80, 82. When an actuation force is applied to the lever handle 12 (see FIG. 1), a torque acting in the direction of arrow 80 is transmitted into the spindle 30 causing the spindle 30 to rotate in the direction of arrow 80. The second magnet 26 will rotate with the spindle 30 which will cause the magnets 24, 26 to misalign and generate a magnetic force between the magnets 24, 26. The magnetic force generates a return torque in the direction of arrow 82 in the opposite direction of the actuation torque in the direction of arrow 80. The lever handle (not shown) can rotate in the direction of arrow 80, when the actuation of torque acting in the direction of arrow 80 is greater than the magnetic torque acting in the direction of arrow 82. When the actuation torque (acting in the direction of arrow 80) is removed, then the return torque (acting in the direction of arrow 82) will cause the lever handle 12 to rotate back in the opposite direction until the lever handle apparatus 10 is in the initial position again. It should be understood that the direction of the acting torques acting in the direction of arrows 80, 82 may be reversed and the operation of the lever apparatus 10 would work in the same manner as described above. In either case, the magnet assembly 25 will cause the the lever handle 12 to return back to the initial base or neutral position without use of other mechanical mechanisms such as springs or the like.

Referring now to FIGS. 7-10, a lever handle apparatus 100 according to alternate embodiments of the present disclosure is shown. A lever handle 110 can be rotatable disposed with a structure such as a rose 112. A movable magnet 114 (FIGS. 7 and 8) or 114*b* (FIGS. 9 and 10) can be operably coupled to the lever so as to move toward (FIG. 8) or away (FIG. 10) from a fixed magnet 116 as the lever 110 is rotated. The magnets 114, 114*b* can move in a substantially linear direction relative to the fixed magnet 116. It should be noted that movement of the magnets 114, 114*b* may include rotational movement as well as linear movement relative to the fixed magnet 116. The embodiment shown in FIGS. 7 and 8 include magnets with the same pole in magnetic communication (i.e. both north or both south) such that a repulsive force causes the lever 110 to move back to an initial position after an actuation force is removed from the handle 110. The embodiment shown in FIGS. 9 and 10 include magnets with opposite poles in magnetic communication (i.e. one north pole and one south pole) such that an attractive force causes the lever 110 to move back to an initial position after an actuation force is removed from the lever 110. It should be understood that the embodiments illustrated in FIGS. 7-10 are exemplary in nature and that more than two magnets may be employed with the lever handle apparatus 100.

In one aspect the present disclosure includes a handle assembly comprising: a mounting plate connectable to a structure; a handle rotatably mounted to the mounting plate; a first magnet coupled to the mounting plate; a second magnet coupled to the handle; wherein the first and second magnets are rotatable relative to one another and are configured to generate a return torque in response to rotation of the handle from a first position.

In refining aspects, the first magnet is fixed and the second magnet is rotatable, wherein a magnet cage configured to hold the first magnet, the magnet cage having a plurality of projections extending away from an outer perimeter and across a portion of the first magnet; wherein the first magnet includes a circular perimeter with one or more extension ears extending therefrom; wherein the one or more extension ears of the first magnet are positioned between the projections of the magnet cage; wherein the magnet cage is formed from a nonmagnetic material; wherein the magnet cage is formed from a plastic material; and further comprising a spindle connected to the lever and the second magnet.

Another aspect of the present disclosure includes a lever connected to a latch assembly, the lever operable to open the latch when rotated to a second position from a first position under an actuation torque; a magnet assembly including first and second magnets operably coupled to the lever; wherein the magnet assembly is operable to generate a return torque opposite of the actuation torque to return the lever to the first position after the actuation torque is removed from the lever.

In refining aspects, the first and second magnets are configured to rotate relative to one another; a magnet holder positioned between the first and second magnets; wherein the magnet holder is formed from a non-magnetic material; wherein the magnet holder is further defined by an arcuate disk with an aperture formed therethrough; at least one post projecting outward from one side of the disk; and a plurality of arcuate projections extending from an outer perimeter of a second opposing side of the disk; wherein the first magnet includes an arcuate outer perimeter wall with one or more extension ears projecting therefrom; wherein the extension ears of the first magnet are positioned between the arcuate projections of the magnet holder to prevent rotation of the first magnet relative to the magnet holder; wherein the at least one post of the magnet holder is engaged with a fixed mounting plate; further comprising a spindle connected to the lever handle; wherein the second magnet is coupled to the spindle such that as the lever handle is rotated under an actuation torque, the second magnet rotates relative to the first magnet and a magnetic force between the first and second magnets generates a torque on the spindle opposite direction to that of the actuation torque.

Another aspect of the present disclosure includes a method comprising: coupling a magnet assembly to a lever handle; moving the lever handle from an initial position to another position; rotating a spindle during the moving of the lever handle; generating a magnetic force within the magnet assembly when the lever handle is moved from the initial position; and returning the lever spindle to the initial position with the magnetic force.

Refining aspect includes a method wherein the magnet assembly includes at least two magnets rotatably coupled to one another such that the magnetic force generated between the magnets is minimized when the lever handle is at the initial position and the magnetic force increases as the lever moves away from the initial position; further comprising positioning a nonmagnetic magnet holder between the first and second magnets, and the magnet holder configured to permit rotation of one of the first and second magnets relative to one another; and wherein the magnet assembly includes at least two magnets linearly movable relative to one another such that the magnetic force generated between the magnets is minimized when the lever handle is at the initial position and the magnetic force increases as the lever moves away from the initial position; varying the magnetic force as a function of a position of the lever handle; wherein the varying of the magnetic force includes an increasing force over a first range of rotation angles and a constant force over a second range of angles.

Another aspect of the present disclosure includes a handle assembly comprising a mounting plate connectable to a structure; a handle rotatably mounted to the mounting plate; a first magnet coupled to the mounting plate; a second magnet coupled to the handle; wherein at least one of the first and second magnets are movable at least partially in a linear direction relative to the other when the handle is rotated; and wherein a magnetic force between the first and second magnets acts to provide a torque in the opposite direction to an actuation torque on the handle; and wherein the magnetic force between the first and second magnets may increase over a range of rotation angles of the handle as it is rotated from a first position and wherein the magnetic force is either an attractive force or a repulsive force.

It should be understood that the component and assembly configurations of the present disclosure can be varied according to specific design requirements and need not conform to the general shape, size, connecting means or general configuration shown in the illustrative drawings to fall within the scope and teachings of this patent application.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A handle assembly, comprising:

a rotatable handle;

a first magnet coupled to a structure; and a second magnet coupled to the rotatable handle such that, in response to rotation of the rotatable handle from a home position, the second magnet is operable to move toward or away from the first magnet; and wherein the first magnet and the second magnet generate magnetic forces that interact to generate a return torque in response to rotation of the rotatable handle from the home position.

2. The handle assembly of claim 1, further comprising a mounting plate attached to the structure, and wherein the first magnet is fixedly mounted to the mounting plate.

3. The handle assembly of claim 1, wherein the first magnet and the second magnet are configured to increase the return torque over a first range of rotation of the rotatable handle.

4. The handle assembly of claim 3, wherein the first range of rotation spans between the home position and a second position.

5. The handle assembly of claim 1, wherein the return torque increases as the second magnet moves toward the first magnet, and wherein the return torque decreases as the second magnet moves away from the first magnet.

6. The handle assembly of claim 1, wherein the rotatable handle is mounted for rotation about a rotational axis; and wherein the second magnet is offset from the rotational axis.

7. The handle assembly of claim 1, wherein the return torque acts to urge the rotatable handle toward the home position.

8. A handle assembly, comprising:

a rotatable handle;

a first magnetic means coupled to a structure for providing a first magnetic field; and a second magnetic means coupled to the rotatable handle for providing a second magnetic field; and wherein the second magnetic means, in response to rotation of the rotatable handle from a home position, is movable toward or away from the first magnetic means, such that the first and second magnetic fields interact to generate a return torque in response to rotation of the rotatable handle from the home position.

9. The handle assembly of claim 8, wherein the first magnetic field and the second magnetic field interact to vary the return torque over a first range of rotation of the rotatable handle.

10. The handle assembly of claim 9, wherein the first range of rotation of the rotatable handle spans between the home position and a second position.

11. The handle assembly of claim 9, wherein the return torque increases as the second magnet moves toward the first magnet, and wherein the return torque decreases as the second magnet moves away from the first magnet.

12. The handle assembly of claim 8, wherein the return torque acts to urge the rotatable handle toward the home position.

13. A method, comprising:

coupling a magnet assembly to a handle assembly comprising a rotatable handle, the magnet assembly including a first magnet and a second magnet, wherein the coupling comprises coupling the first magnet to a structure and coupling the second magnet to the rotatable handle;

generating a magnetic force between the first magnet and the second magnet;

in response to rotation of the handle relative to the structure from a home position toward a second position, moving the second magnet toward or away from the first magnet, thereby varying the magnetic force as a function of a position of the rotatable handle; and returning the rotatable handle to the home position via the magnetic force.

14. The method of claim 13, wherein the first magnet is stationary and the second magnet is rotatable about an axis of rotation.

15. The method of claim 13, wherein the varying of the magnetic force includes an increasing force over a first range of handle rotation.

16. The method of claim 15, wherein the first range of handle rotation spans between the home position and the second position.

17. The method of claim 13, wherein the structure is a housing to which the rotatable handle is rotatably coupled.

18. The method of claim 13, wherein varying the magnetic force comprises increasing the magnetic force as the second magnet moves toward the first magnet, and decreasing the magnetic force as the second magnet moves away from the first magnet.

* * * * *